US008522594B2

(12) United States Patent
Okabe et al.

(10) Patent No.: US 8,522,594 B2
(45) Date of Patent: Sep. 3, 2013

(54) ENLARGEMENT PROCESSING METHOD FOR WORKPIECE

(75) Inventors: Nagatoshi Okabe, Yokohama (JP); Eiji Yamashita, Chigasaki (JP)

(73) Assignee: Neturen Co., Ltd., Tokyo (JP)

( * ) Notice: Subject to any disclaimer, the term of this patent is extended or adjusted under 35 U.S.C. 154(b) by 255 days.

(21) Appl. No.: 13/056,721

(22) PCT Filed: Jul. 21, 2009

(86) PCT No.: PCT/JP2009/063051

§ 371 (c)(1),
(2), (4) Date: Jan. 31, 2011

(87) PCT Pub. No.: WO2010/013618

PCT Pub. Date: Feb. 4, 2010

(65) Prior Publication Data

US 2011/0132060 A1 Jun. 9, 2011

(30) Foreign Application Priority Data

Jul. 31, 2008 (JP) ..... 2008-197705

(51) Int. Cl.
*B21J 5/08* (2006.01)
*B21J 5/06* (2006.01)

(52) U.S. Cl.
USPC ..... 72/377; 72/407; 72/430; 72/710

(58) Field of Classification Search
USPC ..... 72/199, 206, 377, 407, 416, 430, 72/710
See application file for complete search history.

(56) References Cited

U.S. PATENT DOCUMENTS 4,578,983 A * 4/1986 Kimura ..... 72/407
5,699,693 A * 12/1997 Nogami et al. ..... 72/199

FOREIGN PATENT DOCUMENTS

JP 8090010 4/1996
JP 3788751 6/2006

* cited by examiner

*Primary Examiner* — David B Jones
(74) *Attorney, Agent, or Firm* — Roylance, Abrams, Berdo & Goodman, LLP

(57) ABSTRACT

A workpiece enlarging method is provided, by which an enlarged portion can stably be formed on a portion of a workpiece such as a shaft member, and a drive force required to form the enlarged portion can be reduced. The workpiece enlarging method forms the enlarged portion on the workpiece (W) by applying, with respect to the workpiece (W), alternating shear energy in a transverse direction thereof so as to suppress deformation of the workpiece (W) within an elastic limit while applying compression energy that produces compressive stress equal to or greater than an initial yield strength to increase internal energy of the workpiece (W), thereby decomposing a portion of the increased internal energy by the alternating shear energy and deforming and enlarging the enlargement intended area of the workpiece (W) with the assistance of the decomposed energy obtained by the decomposition.

15 Claims, 11 Drawing Sheets

ENLARGEMENT PROCESSING METHOD FOR WORKPIECE

TECHNICAL FIELD

The present invention relates to an enlarging method for deforming and enlarging a portion of a workpiece made of a plastic material and having an axis, more specifically, a portion of an outer surface of the workpiece.

BACKGROUND ART

As a method for providing a shaft member made of a metal material as a plastic material with a desired stepped configuration, there is known a shaft enlarging working in addition to methods such as cutting, pressing or die forging (see, e.g., Patent Document 1). According to the working method disclosed in Patent Document 1, while rotating a shaft member, bending is applied to the shaft member while applying a compressive force to the shaft member in its axial direction. The compressive force and the bending plastically deform, that is, enlarge a portion of an outer circumferential surface of the shaft member so as to form the portion of the outer circumferential surface into an enlarged portion.

According to this enlarging method, differently from the cutting, swarf is not generated, and machining time is remarkably reduced. Further, as compared with a working machine for executing the pressing or the die forging, a working machine for executing the enlarging method can be downsized and working load can be reduced. Therefore, attention is being drawn to the enlarging method in recent years.

RELATED ART DOCUMENT

Patent Document

Patent Document 1: Specification of Japanese Patent No. 3788751

SUMMARY OF THE INVENTION

Problem That the Invention is to Solve

The enlarging method of Patent Document 1 is based on the mechanistic rationale of plastic working. More specifically, the shaft portion is bent at a bending angle of 3° to 6° with respect to an axis thereof while the shaft member is rotating, and this bending repetitively adds rotational bending stress to the shaft member. Consequently, the enlarging method of Patent Document 1 uses the rotational bending stress as a driving force for the enlarging process the rotational bending stress as a driving force for the enlarging process and produces a gradual plastic deformation in the shaft member to enlarge a portion of the shaft member.

In the case of the enlarging method of Patent Document 1, however, the compressive force applied in the axial direction of the shaft member is so small as to merely compensate for an axial contraction of the shaft member resulting from the enlargement of the shaft member, and more specifically, is smaller than the initial yield strength of the workpiece. Therefore, when the shaft member is bent more than the bending angle described above during the enlarging process, the portion of the shaft member that receives the bending largely deviates from the original axis of the shaft member, which is likely to result in a buckling in the shaft member, and it is difficult to stably fabricate an enlarged portion on the shaft member.

It is an object of the present invention to provide a workpiece enlarging method which can stably form an enlarged portion on a workpiece without causing a buckling of the workpiece, requires less energy to decompose internal energy, and can reliably avoid fatigue damage to the workpiece during working.

Means for Solving the Problem

With a view to achieving the object, the present invention provides an enlarging method for generating a plastic enlarging deformation of an outer surface of a workpiece made of a plastic material, the workpiece including an axis and a non-restrained enlargement intended area on the outer surface thereof. More specifically, the method according to the present invention includes holding the workpiece, and applying, in a transverse direction intersecting the axis, alternating energy that deforms the workpiece within an elastic limit thereof while applying compression energy that produces, in the workpiece, compressive stress equal to or greater than an initial yield strength to increase internal energy of the workpiece, by which the alternating energy plastically deforms and enlarges the enlargement intended area while decomposing and consuming a portion of the internal energy increased by the compression energy.

According to the method of the present invention described above, the alternating energy merely adds a repetitive stress that causes an elastic deformation of the workpiece in the transverse direction of the workpiece. However, the repetitive stress is sufficient to effectively decompose the internal energy of the workpiece that is increased as a result of the application of the compression energy. Therefore, the portion of the decomposed energy obtained from the decomposition of the internal energy is consumed while generating a plastic flow in the plastic material that forms the workpiece, whereby the plastic enlarging deformation is generated in the enlargement intended area of the workpiece which is in the non-restrained condition.

More specifically, the repetitive stress becomes the largest at the shaft center of the workpiece and becomes zero on an outer circumference of the workpiece. Therefore, the internal energy is decomposed at the shaft center of the workpiece and the plastic flow described above is induced from the shaft center of the workpiece. Consequently, as long as the application of the compression energy and the alternating energy to the workpiece is maintained, the enlarging deformation proceeds gradually and reliably in the enlargement intended area based on a so-called mechanical ratchet phenomenon while consuming the decomposed energy obtained as a result of decomposing the internal energy, that is, with the assistance of the decomposed energy. As a result, the enlargement intended area of the workpiece is formed into a desired enlarged portion.

More specifically, the compression energy is compressive force that compresses the workpiece either in an axial direction or in a radial direction thereof, and the alternating energy is applied, in a cross section of the workpiece, as given alternating shear energy per unit volume. The alternating shear energy produces repetitive shear stress in the workpiece by forcibly displacing an end portion of the workpiece positioned on one side of the enlargement intended area in the axial direction of the workpiece, or is produced by applying alternating impact torque to the workpiece.

Further, when the workpiece is a hollow tubular member, the alternating energy may also be produced by acoustic energy. More specifically, with one end of the workpiece being closed, ultrasonic waves are introduced into the workpiece from the other end of the workpiece. Meanwhile, when deforming and enlarging the enlargement intended area, an external shape restraint member may be used. This external shape restraint member is arranged to surround the enlargement intended area, and an inner surface configuration of this external shape restraint member defines an outer peripheral configuration of an enlarged portion obtained by enlarging the enlargement intended area. For example, the external shape restraint member may be used to form the enlarged portion as a bevel gear. Further, the external shape restraint member may be joined integrally to the enlarged portion, and in this case, the enlarged portion is connected to the external shape restraint member by force-fitting, that is, enlargement fitting.

Detailed methods for forcibly displacing the end portion of the workpiece will be apparent from the accompanied drawings and embodiments of the invention which will be described below.

Advantageous Effects of the Invention

The enlarging method of the present invention deforms and enlarges the enlargement intended area of the workpiece stably by applying, to the held workpiece, the compression energy that produces the compressive stress equal to or greater than the initial yield strength and the alternating energy in the transverse direction of the workpiece that deforms the workpiece within the elastic limit thereof. According to the present invention, it is not necessary to apply excessive alternating energy to the workpiece, and thus, there is no such situation that a buckling distortion or fatigue damage is generated in the workpiece during the enlarging process, whereby it is possible to reliably form the desired enlarged portion on the workpiece.

Further, since a portion of the internal energy increased within the workpiece is used for forming the enlarged portion, the alternating energy required to proceed the enlarging deformation and heat produced in association with the enlarging deformation can be reduced, so that an increase in temperature of the workpiece is effectively suppressed. As a result, according to the enlarging method of the present invention, the enlarging process can be carried out while preventing a thermal alteration of the workpiece such as blue brittleness without cooling the workpiece, whereby the workability of the enlarging process is greatly improved.

EMBODIMENTS OF THE INVENTION

Figure 1:
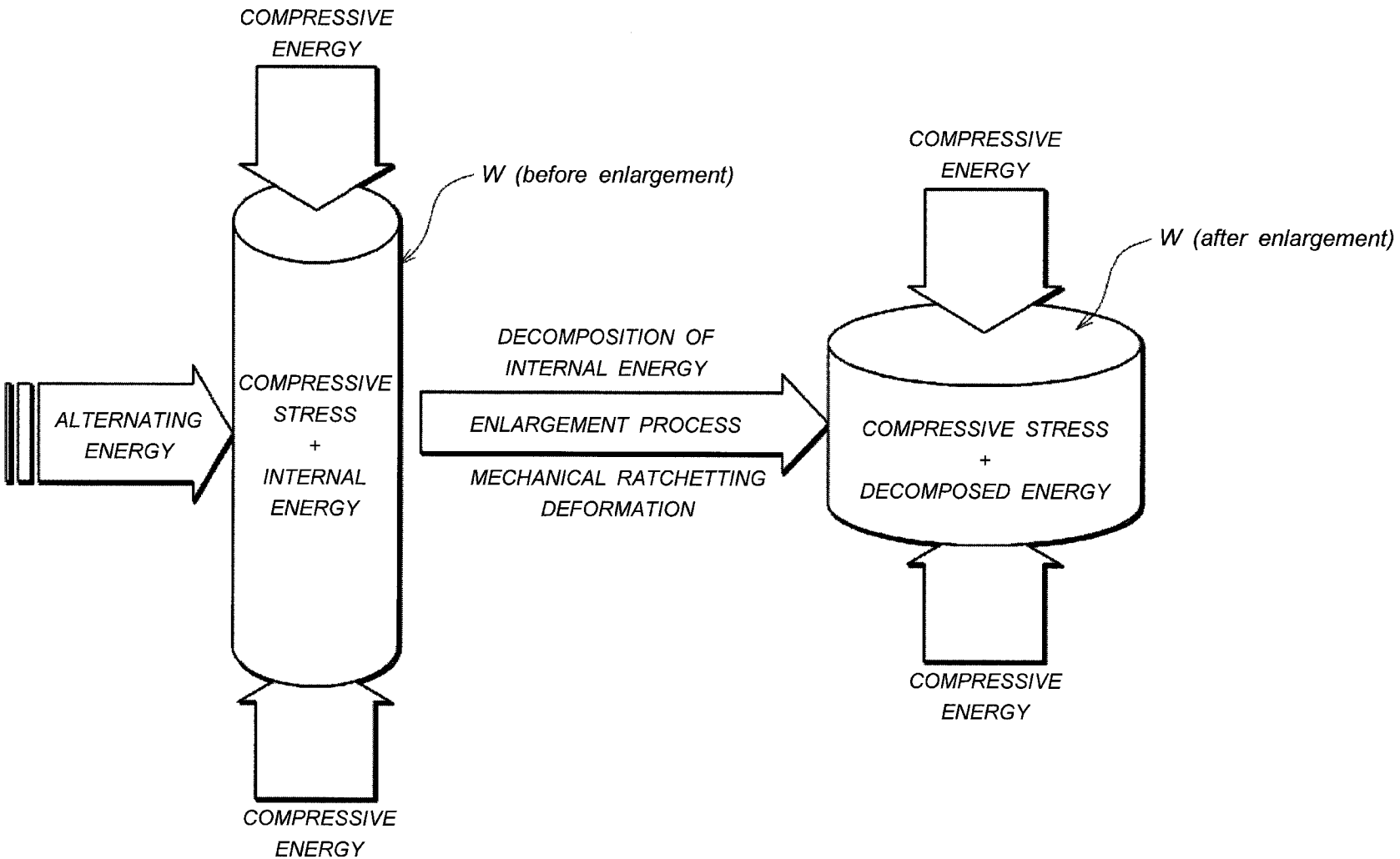
FIG. 1 is a diagram for schematically explaining a mechanism of an enlarging method of the present invention.

In FIG. 1, a workpiece W is shown as a shaft member made of a plastic material, more specifically, a metal material. An enlarging method of the invention is carried out by increasing internal energy in the workpiece W by applying a compressive stress equal to or greater than an initial yield strength of the workpiece W to the workpiece W as compression energy and applying alternating energy in a transverse direction which intersects an axis of the workpiece W, and the alternating energy applies a repetitive stress within an elastic limit of the workpiece W and is suppressed to such an extent that the workpiece W is deformed. In FIG. 1, the compression energy is represented by a compressive force which is applied to the workpiece W in an axial direction thereof from both ends of the workpiece W.

When the alternating energy is applied in the transverse direction of the workpiece W repeatedly, a repetitive stress is provided within a cross-sectional surface of the workpiece. The repetitive stress decomposes the internal energy of the work piece W to thereby produce decomposed energy. Part of the decomposed energy is consumed while producing a plastic flow in the workpiece.

Since the repeated bending stress becomes the largest at a shaft center of the workpiece W and becomes zero on an outer circumference of the workpiece W, the plastic flow is induced from the shaft center of the workpiece W. Therefore, in case the application of the compression energy and the alternating energy to the workpiece W is maintained and the workpiece has an enlargement intended area (corresponding to an outer circumferential surface of a whole axial area of the workpiece W in the example shown in FIG. 1) which is in a non-restrained state, the plastic flow induced from the shaft center of the workpiece W is facilitated with the assistance of the decomposed energy within the enlargement intended area, and the enlargement intended area is deformed and enlarged gradually based on a so-called mechanical ratchet phenomenon.

Figure 2:
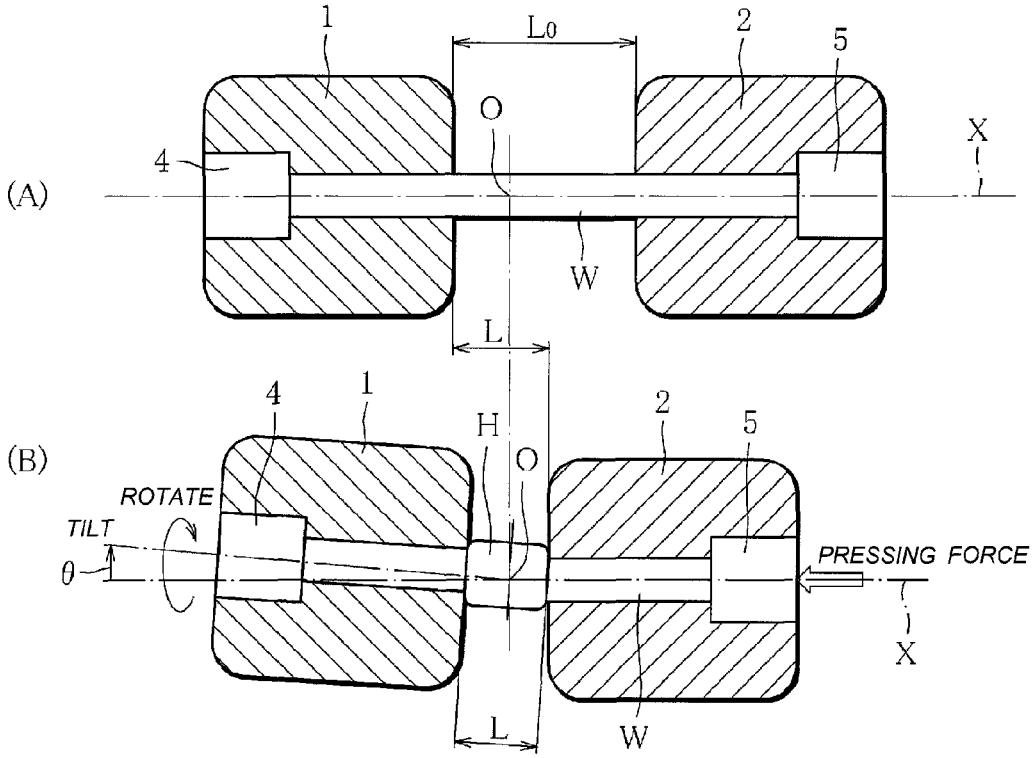
FIG. 2 is a schematic view of a working machine for executing an enlarging method of a first embodiment, in which (A) illustrates a state of the working machine before working a workpiece, and (B) illustrates a state of the working machine in the process of working the workpiece.

(A) and (B) of FIG. 2 show schematically a working machine which executes an enlarging method of a first embodiment. The working machine includes a reference line X and a pair of sleeve holders 1, 2. These sleeve holders 1, 2 are disposed on the reference line X and are spaced apart from each other along the reference line X. The sleeve holder 1 can rotate about the reference line X and can also tilt on the reference line X, that is, about a tilting center O. Further, in the working machine shown in FIG. 2, a tilting angle θ and the tilting center O of the sleeve holder 1 with respect to the reference line X can individually adjusted.

On the other hand, the sleeve holder 2 is supported rotatably about the reference line X and can move along the reference line X, that is, can move towards and away from the sleeve holder 1. Further, the sleeve holder 2 can receive a given pressing force directed towards the sleeve holder 1. The sleeve holders 1, 2 each have a sleeve hole, and these sleeve holes can receive end portions of the workpiece W at corresponding ends. Both ends of the workpiece W which are received in the sleeve holes are supported by support members 4, 5, and these support members 4, 5 are disposed in the corresponding sleeve holders 1, 2. Therefore, the workpiece W is held between the support members 4, 5 in such a state that an axis thereof coincides with the reference line X. In the case of this embodiment, the workpiece W is a solid shaft member made of the metal material.

(A) of FIG. 2 shows an initial state in which the workpiece W is set between the sleeve holders 1, 2, that is, a state before enlarging the workpiece W. In this way, when the workpiece W is in the initial state, the sleeve holders 1, 2 are spaced by a given distance $L_0$ away from each other along the reference line X. In this case, an enlargement intended area of the workpiece W is defined by an outer circumferential surface of the workpiece W which is exposed from the sleeve holders 1, 2 and is in a non-restrained state. Although the tilting center O of the sleeve holder 1 is spaced by a given distance away from the sleeve holder 1 towards a side of the sleeve holder 2, the tilting center O exists on the axis of the workpiece W within the enlargement intended area.

When a pressing force is started to be applied to the sleeve holder 2 from the initial state, the workpiece W receives compression energy, that is, a compressive force in the axial direction thereof. The compressive force produces in the workpiece W a compressive stress equal to or greater than the initial yield strength thereof, whereby internal energy of the workpiece W is increased. In case the sleeve holder 1 is started to be rotate about the reference line X while the sleeve holder 1 is started to be tilted in the above compressed state, the workpiece W rotates about the axis thereof together with the sleeve holders 1, 2, while the workpiece W is bent together with the sleeve holder 1 from a bending center which coincides with the tilting center O. The tilting angle θ of the workpiece W is suppressed so that a bending deformation of the workpiece W is to fall within a deformation at an elastic limit thereof.

The rotating and bending actions of the workpiece W trigger a forced displacement in a portion of the workpiece W which is positioned within the sleeve holder 1. The forced displacement produces the alternating energy in the cross section of the workpiece W which intersects the axis (the reference line X) thereof at right angles, more specifically, certain alternating shear energy is produced per unit volume. The alternating shear energy adds a repetitive shear stress into the cross section of the workpiece W, and this repetitive shear stress decomposes a portion of the internal energy of the workpiece W which is increased by the compression energy. Decomposed energy obtained from this decomposition is consumed by inducing a plastic flow of the material from the shaft center within the workpiece W.

Consequently, in case the application of the compression energy and the alternating shear energy to the workpiece W is maintained, the plastic flow of the material is promoted with the assistance of the decomposed energy within the enlargement intended area of the workpiece W, that is, the portion of the workpiece W in the non-restrained state. In other words, an enlarging deformation is produced in the enlargement intended area of the workpiece W based on the mechanical ratchet phenomenon, and as is shown in (B) of FIG. 2, the enlargement intended area is deformed to be enlarged radially outwards, whereby an enlarged portion H is formed in the workpiece W.

On the other hand, as the enlarging deformation proceeds gradually, the pressing force continuing to be applied to the sleeve holder 2, that is, the compression energy (the compressive force) moves the sleeve holder 2 towards the sleeve holder 1. Thereafter, when the enlarged portion H grows into a collar having a desired diameter and the space between the sleeve holders 1, 2 is reduced from $L_0$ to L, the sleeve holder 1 is returned so as to stay on the reference line X while the tilting angle of the sleeve holder 1 is reduced gradually, and then, the rotation of the sleeve holder 1 is stopped. Thereafter, the worked workpieces W is removed from between the sleeve holders 1, 2.

During the enlarging process, the bending of the workpiece W, that is, the tilting angle θ of the sleeve holder 1 or the position of the bending center O of the workpiece W can be controlled. These controls not only reliably suppresses the bending of the workpiece W within the elastic limit thereof but also becomes effective in making suitable the magnitude and distribution of the repetitive shear stress within the cross section of the workpiece W, thereby making it possible to realize a stable development of the enlarged portion H.

The enlarging deformation of the workpiece W is produced not only in the enlarged portion H but also in the portions of the workpiece W which are situated within the sleeve holders 1, 2. Therefore, as the enlarging process of the workpiece W proceeds, the sleeve holders 1, 2 grips both the end portions of the workpiece W strongly and rigidly. Therefore, the sleeve holders 1, 2 do not require a special chuck for the workpiece W.

Figure 3:
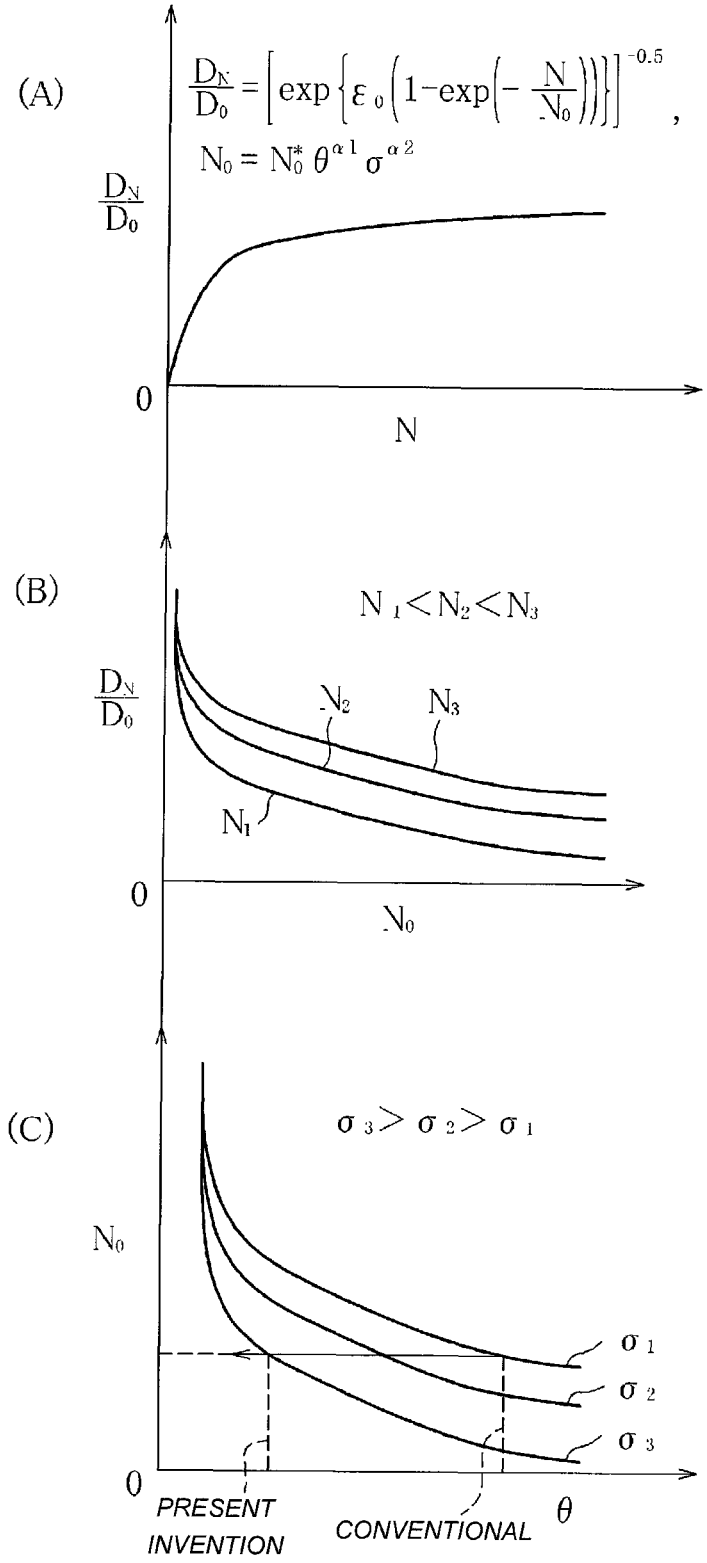
FIG. 3 shows states of the workpiece while it is being worked, in which (A) is a graph showing a relationship between the number of rotations of the workpiece and an enlarging rate of the workpiece, (B) is a graph showing a relationship between a rotation time constant and the enlarging rate, and (C) is a graph showing a relationship between compressive stress and the rotation time constant of the workpiece.

In FIG. 3, (A) shows that when an enlarging process of the workpiece W is executed with the compressive stress and the tilting angle 8 of the workpiece W set to given values, the enlarging deformation of the workpiece W proceeds as the number of rotations N of the workpiece W increases. In (A) of FIG. 3, $D_N/D_0$ denotes the enlarging rate of the enlarged portion H. Namely, $D_0$ and $D_N$ denote an outside diameter of the workpiece W and an outside diameter of the enlarged portion H, respectively.

Here, $D_N/D_0$ can be obtained from the expressions set forth in (A) of FIG. 3, symbols in the expressions denote the following.

$\epsilon_0$: Mean axial distortion $N_0$: Rotation time constant $N_0$*: Bending angle dependent factor for $N_0$ $\sigma_c$: Axial compressive stress of workpiece W θ: Tilting angle $\alpha_1$: Tilting angle dependent index for $N_0$ $\alpha_2$: Pressing stress dependent index for $N_0$ On the other hand, (B) of FIG. 3 shows the result of (A) of FIG. 3 as being replaced by a relationship between the rotation time constant $N_0$ and the enlargement rate $D_N/D_0$ using the number of rotations of the workpiece W as a parameter. (C) of FIG. 3 shows a relationship between the tilting angle θ and the rotation time constant $N_0$ of the workpiece W using the tilting compressive stress $\theta_C$ as a parameter. (A) of FIG. 3 represents that the enlarging rate $D_N/D_0$ converges to a certain value as the number of rations N increases, and (B) of FIG. 3 represents that the enlarging rate $D_N/D_0$ increases as the rotation time constant $N_0$ decreases. In addition, as is clear from (C) of FIG. 3, it is seen that in order to attain the same enlarging rate with the rotation time constant $N_0$ remaining constant, the compressive stress $\sigma_C$ is increased and the tilting angle θ is decreased.

Therefore, as with the embodiment described above, in case the compressive stress of the workpiece W is made equal to or greater than the initial yield strength thereof, while the tilting angle θ is suppressed to such an extent that the bending deformation within the elastic limit thereof is produced in the workpiece W, the enlarged portion H can be formed quickly and effectively in the workpiece W. Namely, as is clear form (C) of FIG. 3, in the conventional enlarging method disclosed in Patent Document 1 described above, the enlarging process of the workpiece W is performed based on the compressive stress of the workpiece W as basic load and tension and compression stress which is added repeatedly to the workpiece W by the rotational bending of the workpiece W as driving force for gradual plastic deformation.

In contrast with this, in the enlarging method of the invention, the enlarging process of the workpiece W is performed by increasing the internal energy accumulated in the workpiece W by the compressive stress (the compression energy) of the workpiece W, while decomposing a portion of the internal energy so increased using the alternating shear energy produced by the rotational bending of the workpiece W as a trigger and using the decomposed energy obtained by the decomposition as driving force for gradual plastic deformation.

Therefore, according to the enlarging method of the invention, compared with the conventional method, the tilting angle θ required by the workpiece W is only of the order of one tenth the tilting angle θ of the conventional method. This means that a high-speed rotation of the workpiece W is enabled and that time required for the enlarging process can also be largely reduced. FIGS. 4 to 7 schematically show part of a working machine which executes an enlarging method of a second embodiment.

Figure 4:
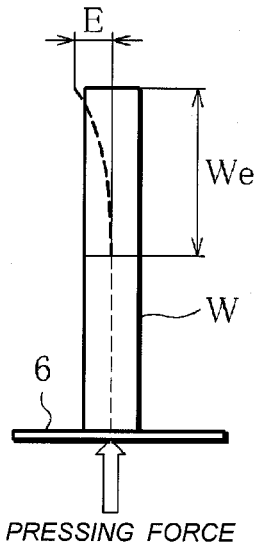
FIG. 4 is a side view showing a part of a working machine for executing an enlarging method of a second embodiment, that is, a holding member for holding one end of a workpiece.
Figure 5:
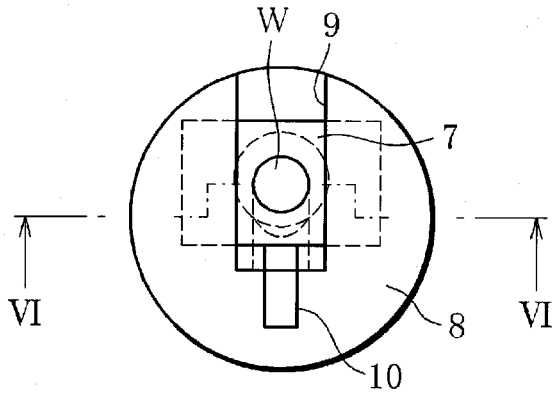
FIG. 5 is a plan view showing a sleeve holder inside a rotary member which holds the other end of the workpiece of FIG. 4.
Figure 6:
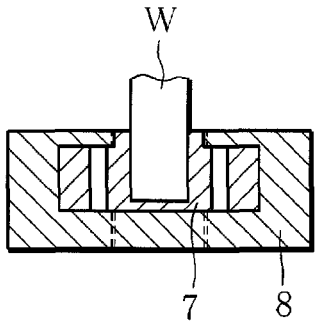
FIG. 6 is a cross-sectional view of the sleeve holder taken along the line VI-VI of FIG. 5.

The working machine of the second embodiment includes a holding member 6 and a sleeve holder 7 which correspond to the sleeve holders 1, 2 described above. As is shown in FIG. 4, the holding member 6 fixedly holds one end of a workpiece W, and in the case of this embodiment, the workpiece W is a hollow shaft member. On the other hand, as is shown in FIGS. 5 and 6, although the sleeve holder 7 holds the other end of the workpiece W, the other end of the workpiece W can rotate relatively to the sleeve holder 7.

More specifically, a disc-shaped rotary member 8 is attached to the sleeve holder 7, and the sleeve holder 7 can be eccentric with respect to a shaft center of the rotary member 8. Specifically, the sleeve holder 7 is slidably fitted in a groove 9 in the rotary member 8 and is allowed to move along the groove 9 by a feed screw 10. Further, the rotary member 8 is allowed to tilt with respect to an axis of the rotary member 8, that is, an axis of the workpiece W.

Figure 7:
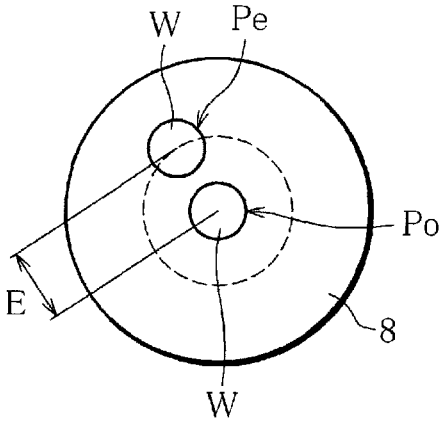
FIG. 7 is a diagram drawing showing an eccentricity of the sleeve holder with respect to the rotary member.

When the workpiece W is held between the holding member 6 and the sleeve holder 7, the sleeve holder 7 is disposed concentric with the rotary member 8. In this state, both ends of the workpiece W are held by the holding member 6 and the sleeve holder 7. Thereafter, the sleeve holder 7 is made eccentric by a given eccentric amount E with respect to the rotary member 8 while the rotary member 8 is tilted. Therefore, as is shown in FIG. 7, the other end of the workpiece W moves to an eccentric position Pe from a position Po which is positioned concentric with the rotary member 8. The movement of the other end of the workpiece W in the way described above applies a bending to an end portion We of the workpiece W which is situated on the rotary member 8 side as indicated by a broken line FIG. 4. As with the first embodiment, the bending of the workpiece W occurring hear is suppressed within an elastic limit thereof.

In this state, the rotary member 8 is rotated, and a pressing force applied to the workpiece W via the holding member 6 produces a compressive stress equal to or greater than an initial yield strength thereof. Therefore, the end portion We rotates while swinging. This swinging rotational motion imparts a forced displacement to the workpiece W. This forced displacement bends repeatedly the end portion We of the workpiece W in accordance with the eccentric amount E of the sleeve holder 7 and produces a repetitive shear stress, that is, alternating shear energy in a cross section of the workpiece W. Therefore, an enlargement intended area of the workpiece W is deformed and enlarged based on a mechanism similar to that of the first embodiment described above, whereby an enlarged portion is formed in the enlargement intended area.

Since the eccentric amount E of the sleeve holder 7 and the tilting angle of the rotary member 8 can be adjusted, also in the case of the second embodiment, the swinging angle of the swinging and rotating motion and the position of the center of the swing are preferably controlled during the enlarging process. The control of the swinging angle and the swing center is effective not only in preventing the application of excessive alternating shear energy to the workpiece W but also in making the magnitude and distribution of alternating shear energy appropriate to the size of an enlarged portion to be formed.

Figure 8:
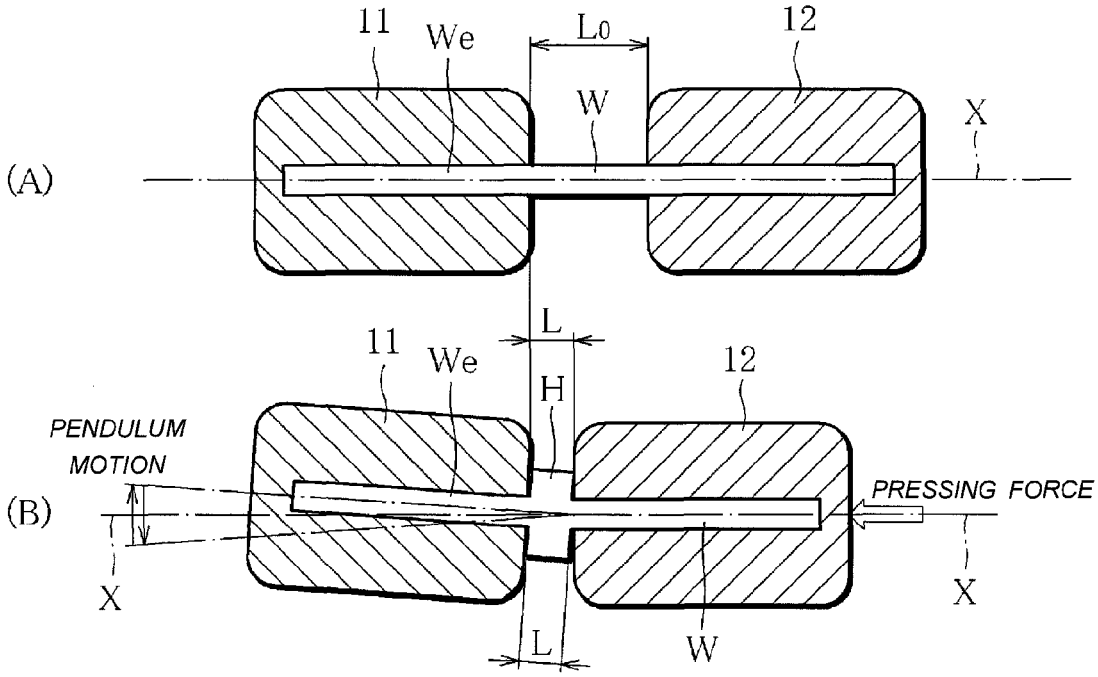
FIG. 8 illustrates a working machine for executing an enlarging method of a third embodiment, in which (A) illustrates a state of the working machine before working a workpiece, and (B) illustrates a state of the working machine in the process of working the workpiece.

(A) and (B) of FIG. 8 schematically show a working machine which executes an enlarging method of a third embodiment. The working machine of the third embodiment also includes sleeve holders 11, 12 which correspond to the sleeve holders 1, 2 of the first embodiment. However, a workpiece W that is held by the sleeve holders 11, 12 is not a shaft member but a strip-like plate member. More specifically, the sleeve holders 11, 12 have rectangular holes which can receive end portions of the workpiece W. The sleeve holders 11, 12 are not such as to be rotated about a reference line X, but only the sleeve holder 11 is allowed to tilt alternately about the reference line X as a center. The alternating tilting of the sleeve holder 11 imparts pendulum vibrations to an end portion We of the workpiece W. The pendulum motion tilts the end portion We of the workpiece W in a reciprocating manner in a direction which intersects a wider surface of the workpiece W at right angles and imparts a forced displacement to the end portion We.

Therefore, in the case of the third embodiment, too, the end portion We is bent repeatedly in such a state that the deformation of the end portion We is restricted to fall within an elastic limit thereof, whereby shear stress, that is, alternating shear energy is applied repeatedly into a cross section of the workpiece W. On the other hand, in case a compressive stress equal to or greater than an initial yield strength of the workpiece W is applied to the workpiece W by a pressing force applied to the workpiece W via the sleeve holder 12, the alternating shear energy and the compressive stress (the compression energy) forms an enlarged portion H in an enlargement intended area of the workpiece W lying between the sleeve holders 11, 12 based on a mechanical ratchet phenomenon which is similar to the embodiments described above. In the case of the third embodiment, since the sleeve holders 11, 12, that is, the workpiece W is not rotated about an axis thereof, the enlarged portion H of the workpiece W is formed as ribs which project from both sides of the workpiece W.

Also in this embodiment, the tilting angle of the alternating tilting of the sleeve holder 11 and the tilting center position are controlled during the enlarging process, as a result of which there occurs no such situation that excess alternating shear energy is applied to the workpiece W, whereby the alternating shear energy is made appropriate.

Figure 9:
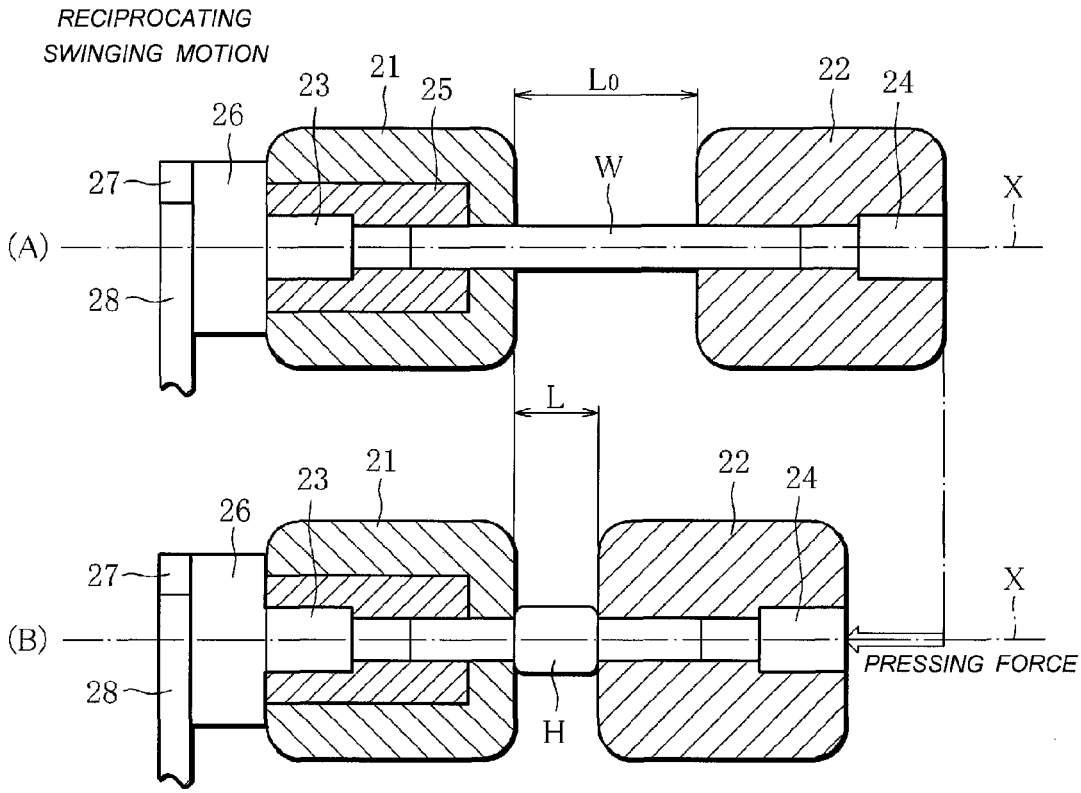
FIG. 9 illustrates a working machine for executing an enlarging method of a fourth embodiment, in which (A) illustrates a state of the working machine before working a workpiece, and (B) illustrates a state of the working machine which completed the working of the workpiece.

(A) and (B) of FIG. 9 schematically show a working machine which executes an enlarging method of a fourth embodiment. The working machine of the fourth embodiment includes sleeve holders 21, 22 which correspond to the sleeve holders 1, 2 of the first embodiment. The sleeve 21 is allowed to rotate about a reference line X, while the sleeve holder 22 is not allowed to so rotate.

To be more specific, in the case of this embodiment, a workpiece W is a solid shaft member, and both end portions of the workpiece W are inserted into the sleeve holders 21, 22. Support members 23, 24 are disposed in the sleeve holders 21, 22, respectively, and these support members 23, 24 each have a stepped cylindrical shape. Both ends of the workpiece W are supported at inner ends, that is, smaller diameter ends of the support members 23, 24, whereby the workpiece W is held between the support members 23, 24. Further, a spacer 25 having a sleeve shape is disposed within the sleeve holder 21, and this spacer 25 surrounds end portions of the support member 23 and the workpiece W in cooperation with the sleeve holder 21.

Figure 10:
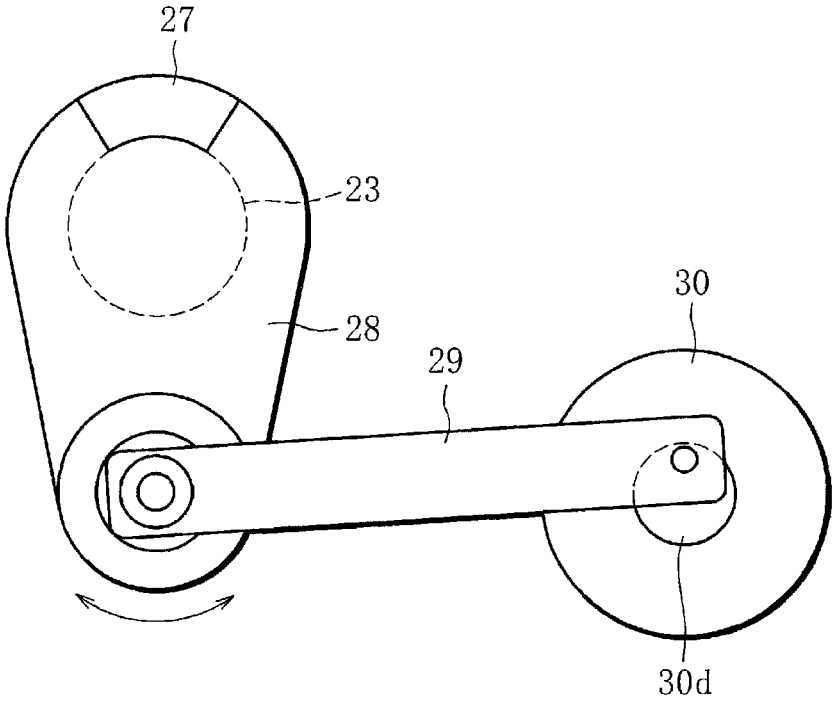
FIG. 10 is a diagram showing a mechanism for rotating a driving member of FIG. 8 in a reciprocating manner.

An outer end, that is, a large diameter end of the support member 23 is connected to a drive member 26, and this drive member 26 has a cylindrical shape and is disposed outside the sleeve holder 21. The drive member 26 has an outer end face on a side opposite the sleeve holder 21, and a projection 27 is formed on an outer circumferential portion of this outer end face. This projection 27 is projected along a reference line X, and as is clear from FIG. 10, the projection 27 is formed in a fan shape. The projection 27 is fitted in one end portion of a crank link 28, and the other end portion of the crank link 28 is connected to one end of a connecting rod 29. The other end of the connecting rod 29 is attached eccentrically to an output shaft 30*d* of a motor 30 with reduction gears.

Figure 11:
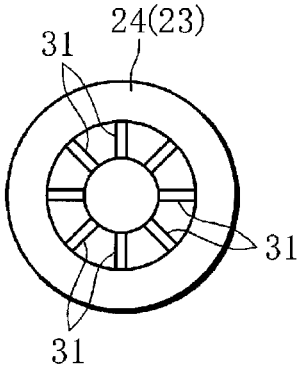
FIG. 11 is a diagram showing an end face of a receiving member of FIG. 8.

According to the working machine of the fourth embodiment, when the motor 30 is driven, the rotation of the motor 30 is transmitted to the drive member 26 via the crank link 28 and the projection 27, so as to be converted into a reciprocating swinging motion, as a result of which the drive member 26 rotates the support member 23 in a reciprocating manner within a given angular range about the reference X as a center. Further, as is shown in FIG. 11, a plurality of teeth 31 are formed on inner end faces of the support members 23, 24, and these teeth 31 are disposed circumferentially at equal intervals on the corresponding inner end faces.

When the workpiece W is held between the inner ends of the support members 23, 24 and a pressing force is applied to the workpiece W via the support member 24, the teeth 31 on the support members 23, 24 bite into corresponding end faces of the work piece W. Therefore, the support members 23, 24 are connected integrally with the workpiece W. Both the end faces of the workpiece W are preferably kept as rough as what results when the workpiece W is cut. As this occurs, the teeth 31 bite deep into the end faces of the workpiece W, whereby the support members 23, 24 can hold the workpiece W therebetween.

As described above, the end portion of the workpiece W in the support member 24 is not allowed to rotate, and the support members 23, 24 are connected integrally with the workpiece W. Further, the pressing force produces in the workpiece W the compressive force equal to or greater than the initial yield strength thereof. In this state, when a reciprocating swinging motion is applied to the support member 23, since this reciprocating swinging motion applies an alternating twisting (circular arc) motion about the axis of the workpiece W to the end portion of the workpiece W which faces the sleeve holder 21, a forced displacement is applied to the workpiece W within the elastic limit thereof.

More specifically, the alternating twisting motion applies alternating shear energy to the workpiece W in a transverse direction, and this alternating shear energy is propagated into the workpiece W. Therefore, a repetitive shear stress is applied into a cross section of an enlargement intended area of the workpiece W which lies between the sleeve holders 21, 22. As a result, as with the cases of the embodiments described before, the enlargement intended area of the workpiece W is deformed and enlarged based on the mechanical ratchet phenomenon, whereby an enlarged portion H like one shown in (B) of FIG. 9 is formed in the workpiece W.

Also in this embodiment, the twisting angle of the workpiece W is controlled during the enlarging process so as not only to prevent the production of excessive alternating shear energy in the workpiece W but also to realize appropriate alternating shear energy. In any of the first to fourth embodiments, the alternating shear energy per unit volume is produced in the workpiece W by imparting the forced displacement to the end portion of the workpiece W. However, in the invention, in place of forcibly displacing the end portion of the workpiece W, the enlargement intended area of the workpiece W can be deformed and enlarged based on the mechanical ratchet phenomenon by applying an alternating impact torque to the end portion of the workpiece W as alternating shear energy.

Figure 12:
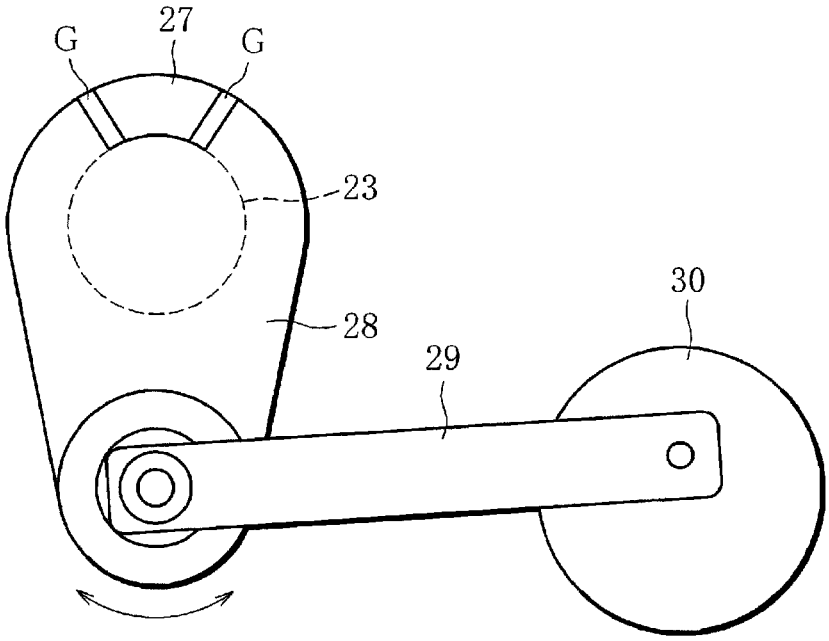
FIG. 12 is a diagram showing a mechanism for applying an impact torque to a workpiece instead of the mechanism of FIG. 9 to execute an enlarging method of a fifth embodiment.

Specifically, FIG. 12 shows a part of a working machine for executing an enlarging method of a fifth embodiment, and this working machine applies an alternating impact torque to a workpiece W. When compared with the working machine of the fourth embodiment, the working machine of the fifth embodiment differs from the working machine of the fourth embodiment only in that a play, that is, a gap G is secured between a projection 27 on a drive member 26 and a crank link 28. Therefore, when the crank link 28 is swung in a reciprocating manner, the crank link 28 can apply an alternating impact torque to the drive member 26, that is, the workpiece W via the projection 27.

The alternating impact torque produces an alternating twisting shear stress wave (alternating shear energy) in a cross section of the workpiece W. This twisting shear stress wave propagates within the workpiece W and, as with the embodiments above, forms an enlarged portion in an enlargement intended area of the workpiece W based on the mechanical ratchet phenomenon.

Figure 13:
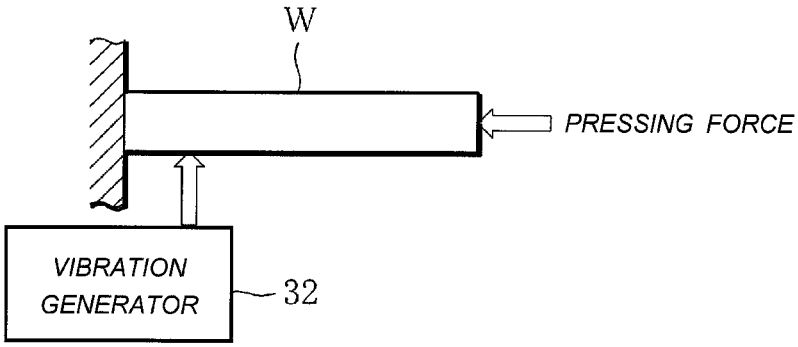
FIG. 13 is a schematic diagram of a working machine for executing an enlarging method of a sixth embodiment.

Further, FIG. 13 shows a working machine for executing an enlarging method of a sixth embodiment. The working machine of FIG. 13 includes a vibration generator 32 and this vibration generator 32 applies bending or twisting vibrations to a cross section of a workpiece W. The bending or twisting vibrations can also produce an alternating twisting shear stress wave (alternating shear energy) within the workpiece W. As a result, the working machine in FIG. 13 can also form an enlarged portion in the workpiece W based on the mechanical ratchet phenomenon as with the cases of the embodiments above.

Figure 14:
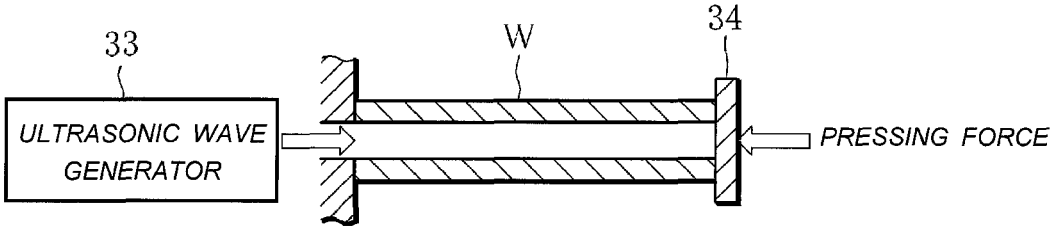
FIG. 14 is a schematic diagram of a working machine for executing an enlarging method of a seventh embodiment.

In the other hand, in the case of a workpiece W being a hollow tubular member, an enlarging method of a seventh embodiment can also be adopted. A working machine executing the enlarging method of the seventh embodiment includes a closure plate 34 which closes one end of a workpiece W and an acoustic energy production source disposed at the other end of the workpiece W, more specifically, an ultrasonic wave generator 33. The ultrasonic wave generator 33 introduces ultrasonic waves into the workpiece W from the other end of the workpiece W. The ultrasonic waves so introduced are of a type of vibration energy, and therefore, the ultrasonic waves propagate within a hollow interior of the workpiece W so as to apply certain alternating shear energy per unit volume in a cross section of the workpiece W. Therefore, the working machine in FIG. 14 can also form an enlarged portion in the workpiece W based on the mechanical ratchet phenomenon as with the cases of the embodiments above.

Figure 15:
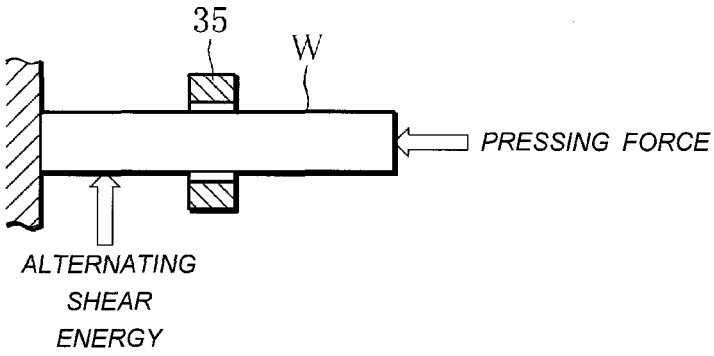
FIG. 15 is a schematic diagram of an enlarging machine for executing an enlarging method of an eighth embodiment.

When acoustic energy such as ultrasonic waves are used in the enlarging process of the workpiece W, ultrasonic waves which propagate within the workpiece W are preferably not standing waves, in which case ultrasonic waves can apply alternating shear energy to the cross section of the workpiece W with good efficiency. Further, FIG. 15 shows a working machine for executing an enlarging method of an eighth embodiment. When compared with the working machines of the first to sixth embodiments, the working machine shown in FIG. 15 differs therefrom only in that the working machine includes further an external shape restraint member 35.

Specifically, the external shape restraint member 35 is a forming die of a female type and has a polygonal, inner teeth-shaped or step-shaped inner surface configuration. The external shape restraint member 35 so configured is disposed so as to surround an enlargement intended area of a workpiece W. In this case, an enlarged portion is formed in the workpiece W inside the external shape restraint member 35, and an external shape of the enlarged portion is determined by the inner surface configuration of the external shape restraint member 35. Namely, the enlarged portion has an external shape which coincides with the inner surface configuration of the external shape restraint member 35. Therefore, the enlarged portion is formed into an arbitrary final shape such as a polygonal, gear-like or step-like shape, which obviates the necessity of post working which would otherwise be done on the enlarged portion.

Figure 16:
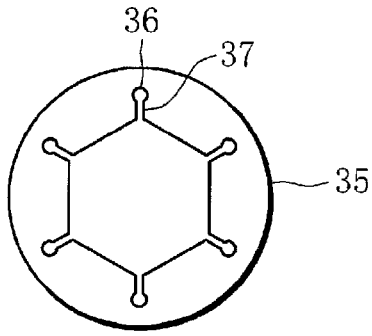
FIG. 16 is a diagram showing an example of an external shape restraint member used in the working machine of FIG. 15.

When the external shape restraint member 35 is used as the female-type forming die, the forming die receives a hardening treatment such as quenching in order to prevent wear or plastic deformation. Because of this, when corner portions are present on an inner surface of the forming die, there is caused a fear that cracks are produced in the forming die due to stress concentration on the corner portions during the enlarging process of the workpiece W. In order to prevent the occurrence of such a fear, in the case of the forming die having an inner surface configuration of a hexagonal hole, for example, as is shown in FIG. 16, the external shape restraint member 35 includes six circular holes 36 and six radial slits 37 in the inner surface thereof. Each radial slit 37 has one end which is opened in a corresponding corner of the hexagonal hole and the other end which is connected to the circular hole 36. The circular hole 36 and the slit 37 reliably prevent cracks from being produced in the external shape restraint member 35 due to the concentration of stress.

Figure 17:
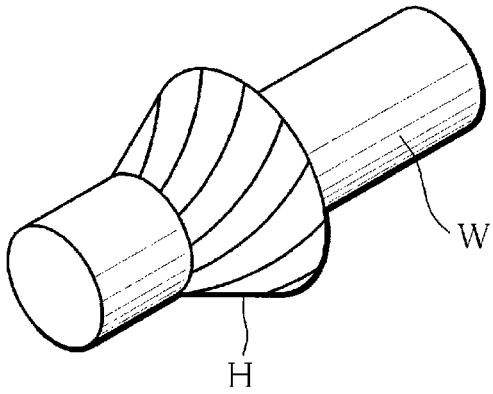
FIG. 17 is a perspective view showing a bevel gear formed as an enlarged portion.

When a forming die which forms a bevel gear is used as the external shape restraint member 35, FIG. 17 shows an enlarged portion which is formed in the workpiece W by use of the forming die, that is, a bevel gear. Further, the external shape restraint member 35 may be joined integrally to the enlarged portion of the workpiece W. In this case, the enlarged portion between the external shape restraint member 35 and the workpiece W realizes an enlargement fitting which is one kind of force-fitting.

The present invention is not limited to the first to eighth embodiments described above. For example, the workpiece is limited to neither the shaft member nor the plate member but can have various shapes. In addition, the alternating energy that is to be applied to the workpiece may also be obtained by combining the forced displacement disclosed in the first to seventh embodiments with vibration or acoustic energy.

Further, the compression energy that is to be applied to the workpiece can be also obtained by pressing the workpiece in the radial direction. Specifically, in this case, for example, a hollow tubular member is used for the workpiece, and a forming die of a female type, more specifically, a forming die for forming rack teeth is pressed against part of an outer circumferential surface of the workpiece. Namely, the forming die applies compression energy to the workpiece in the radial direction thereof. In this state, in case the alternating twisting motion, that is, the alternating shear energy is applied to the workpiece, the enlarged portion of the workpiece develops within the forming die, and the workpiece is formed into a rack.

Further, the center of the tilting motion, the swinging motion or the pendulum motion that is applied to the workpiece W does not necessarily have to be positioned within the enlargement intended area. For example, in the case of the embodiment shown in FIG. 2, the tilting center O of the workpiece W can be positioned within one the sleeve holders. Furthermore, the workpiece W does not necessarily have to be formed of a metal material but may be formed of a non-metal material such as sintered ceramics. In short, any material can be used, provided that the material can be deformed plastically. Lastly, various modifications can of course be made to the illustrated working machines.

EXPLANATION OF REFERENCE NUMERALS AND SIGNS

1, 2 sleeve holder
4, 5 support member
6 holding member
7 sleeve holder
8 rotary member
9 groove
10 feed screw
11, 12 sleeve holder
21, 22 sleeve holder
23, 24 support member
25 spacer
26 drive member
30 motor
32 vibration generator
33 ultrasonic wave generator
34 closure plate
35 external shape restraint member
H enlarged portion
W workpiece
X reference line

The invention claimed is:

1. An enlarging method for generating a plastic enlarging deformation of an outer surface of a workpiece made of a plastic material, wherein the workpiece includes an axis and a non-restrained enlargement intended area on the outer surface thereof, the method comprising:

holding the workpiece, and applying, in a transverse direction intersecting the axis, alternating energy that deforms the workpiece within an elastic limit thereof while applying compression energy that produces, in the workpiece, compressive stress equal to or greater than an initial yield strength of the workpiece to increase internal energy of the workpiece, wherein the alternating energy plastically deforms and enlarges the enlargement intended area while decomposing and consuming a portion of the internal energy increased by the compression energy.

2. The method of claim 1, wherein the compression energy is compressive force that compresses the workpiece either in an axial direction or in a radial direction thereof.

3. The method of claim 2, wherein the alternating energy is applied, in a cross section of the workpiece, as given alternating shear energy per unit volume.

4. The method of claim 3, wherein the alternating shear energy produces repetitive shear stress in the workpiece by forcibly displacing an end portion of the workpiece positioned on one side of the enlargement intended area in the axial direction of the workpiece.

5. The method of claim 4, wherein the forced displacement of the end portion is produced by a combination of a rotation that rotates the workpiece about the axis thereof and a bending of the end portion having a bending center on the axis.

6. The method of claim 5, wherein a bending angle and the bending center of the end portion is controlled during a process in which the enlargement intended area is deformed and enlarged to prevent an excessive application of the alternating shear energy.

7. The method of claim 4, wherein the forced displacement of the end portion is produced by a swinging rotational motion of the end portion, wherein the swinging rotational motion has a center on the axis.

8. The method of claim 4, wherein the forced displacement of the end portion is produced by a pendulum motion of the end portion, wherein the pendulum motion has a center on the axis.

9. The method of claim 4, wherein the forced displacement of the end portion is produced by an alternating twisting motion of the end portion centered on the axis.

10. The method of claim 3, wherein the alternating shear energy is produced by applying alternating impact torque to the workpiece.

11. The method of claim 3, wherein the alternating shear energy is produced by applying a bending or twisting vibration to the workpiece.

12. The method of claim 2, wherein, when the workpiece is a hollow tubular member, the alternating energy is produced by acoustic energy which is introduced, with one end of the workpiece being closed, into the workpiece from the other end of the workpiece.

13. The method of claim 1, wherein the enlargement intended area is surrounded by an external shape restraint member, and an inner surface configuration of the external shape restraint member defines an outer peripheral configuration of an enlarged portion obtained by enlarging the enlargement intended area.

14. The method of claim 13, wherein the external shape restraint member is used as a forming die to form the enlarged portion.

15. The method of claim 13, wherein the external shape restraint member is joined integrally to the enlarged portion.

* * * * *